US008141730B2

(12) United States Patent
Smith et al.

(10) Patent No.: US 8,141,730 B2
(45) Date of Patent: Mar. 27, 2012

(54) CLOSURES FOR MULTIPLE COMPONENT CONTAINERS

(75) Inventors: Matthew Eric Smith, Isle of Man (GB); Karl Mondszein, Mansfield (GB)

(73) Assignee: Carbonite Corporation, Panama (PA)

( * ) Notice: Subject to any disclaimer, the term of this patent is extended or adjusted under 35 U.S.C. 154(b) by 449 days.

(21) Appl. No.: 12/513,317

(22) PCT Filed: Nov. 5, 2007

(86) PCT No.: PCT/GB2007/004215
§ 371 (c)(1),
(2), (4) Date: Jun. 24, 2009

(87) PCT Pub. No.: WO2008/059204
PCT Pub. Date: May 22, 2008

(65) Prior Publication Data

US 2010/0059525 A1 Mar. 11, 2010

(30) Foreign Application Priority Data

Nov. 14, 2006 (GB) ..... 0622699.7
Nov. 23, 2006 (GB) ..... 0623847.1

(51) Int. Cl.
*B65D 25/08* (2006.01)

(52) U.S. Cl. ..... 215/227; 215/228; 215/311; 215/389; 215/260; 206/0.5; 206/221; 222/145.5; 220/714

(58) Field of Classification Search ..... 215/260, 215/311, 227, 228, 387–389; 220/714; 222/145.1, 222/145.5, 145.6; 206/5, 219, 220, 221; 604/87–91, 202–206; 137/859
See application file for complete search history.

(56) References Cited

U.S. PATENT DOCUMENTS 4,634,003 A * 1/1987 Ueda et al. ..... 206/221
(Continued)

FOREIGN PATENT DOCUMENTS

EP 1441963 A 8/2004
(Continued)

OTHER PUBLICATIONS

PCT International Search Report for PCT/GB2007/004215 dated Jan. 24, 2008.

*Primary Examiner* — Anthony Stashick
*Assistant Examiner* — James N Smalley
(74) *Attorney, Agent, or Firm* — Harry K. Ahn; Abelman Frayne & Schwab

(57) ABSTRACT

A closure for a multiple component container includes an insert (12), a piston (20) and a cap (10). The insert (12) and the piston (20) define a reservoir and the insert (12) comprises a fixed cylindrical wall (26) and a movable wall (32) connected thereto and movable with respect thereto by the action of gas pressure within the reservoir. The movable wall (32) has a discharge aperture (36) formed therein. The cap (10) comprises a closure plate (14), integral with whose outer edge is a depending skirt (16), by means of which the cap may be secured to a container. The closure plate (14) cooperates with the piston (20) such that movement of the closure plate towards the insert (12) results in movement of the piston also in the same direction. The piston (20) forms a sliding seal with the internal surface of the fixed cylindrical wall (26). A valve member (22) is integral with, the piston (20) and is slidably received in and seals the discharge aperture (36).

16 Claims, 2 Drawing Sheets

U.S. PATENT DOCUMENTS

| | | | | |
|---|---|---|---|---|
| 6,148,996 | A * | 11/2000 | Morini | 206/222 |
| 2007/0045217 | A1 | 3/2007 | Cho | |
| 2007/0163898 | A1 | 7/2007 | Smith et al. | |
| 2008/0073307 | A1 * | 3/2008 | Sweeney et al. | 215/228 |
| 2009/0260999 | A1 * | 10/2009 | Yang et al. | 206/219 |

FOREIGN PATENT DOCUMENTS

| | | | |
|---|---|---|---|
| WO | 02/092440 | A | 11/2002 |
| WO | 2006/097823 | A | 9/2006 |

* cited by examiner

CLOSURES FOR MULTIPLE COMPONENT CONTAINERS

CROSS REFERENCE TO RELATED APPLICATIONS

This application is a national phase of PCT application No. PCT/GB2007/004215, filed Nov. 5, 2007, which claims priority to GB patent application No. 0622699.7, filed Nov. 14, 2006, and GB patent application No. 0623847.1, filed Nov. 23, 2006, all of which are incorporated herein by reference.

The present invention relates to closures for multiple component containers, which contain two or more different substances or components which are stored separately but are mixed together at the time the container is opened.

There are many fields in which multiple component, particularly binary component, containers are used or are desirable. Thus, there are certain pharmaceutical compositions which are administered in the form of a mixture but which are unstable in the long term in the form of a mixture. The components of such a composition are therefore stored separately and only mixed shortly before administration. In this case, both components are generally in liquid form but it is also possible for one of the components to be in solid or powder form. Such containers may also find application in the foodstuff market, particularly for beverages. Thus is it is desirable, for instance in connection with canned or bottled lager and lime, only to mix the lime into the lager shortly before consumption of the beverage. A further field of application is the cosmetics industry in which certain hair colorants comprise a solvent and a pigment which are unstable in the long term, when mixed together.

It is the object of the invention to provide a closure for a multiple component container which is cheap and simple and which enables one component in the container to be reliably automatically mixed with a second component in the container at the time the container is opened.

According to the present invention, a closure for a multiple component container includes an insert, a piston and a cap, the insert and the piston defining a reservoir and the insert comprising a fixed cylindrical wall and a moveable wall connected thereto and moveable with respect thereto by the action of gas pressure within the reservoir, the moveable wall having a discharge aperture formed therein, the cap comprising a closure plate, integral with whose outer edge is a depending skirt by means of which the cap may be secured to a container, the closure plate cooperating with the piston such that movement of the closure plate towards the insert results in movement of the piston also in the same direction, the piston forming a sliding seal with the internal surface of the fixed cylindrical wall, and a valve member which is integral with the piston and is slideably received in and seals the discharge aperture.

In use, the reservoir will be filled with one component, preferably in liquid form, and the insert will be positioned within a container including a further component of the multiple component system. The cap will be positioned on top of the container with the depending skirt extending around the neck of the container. The piston will defined the upper portion of the reservoir with its outer surface forming a sliding seal with the internal surface of the fixed cylindrical wall. The valve member or spigot depending from the piston will be slideably received within the discharge aperture formed in the moveable wall and will seal it. The reservoir therefore constitutes a sealed ingredient space containing one of the components of the binary component system within the container. If it should be desired to open the container and to dispense its contents in mixed form, the cap is, counter-intuitively, initially moved not upwards but downwards. This downward movement of the cap and thus of the closure plate results in downward sliding movement of the piston within the reservoir whilst maintaining a sliding seal with the internal surface of the fixed cylindrical wall. This movement of the piston will result in a decrease in the volume of the reservoir and thus in the generation of an internal pressure within the reservoir. This internal pressure results in movement of the moveable wall with respect to the fixed wall, that is to say away from the closure plate. The moveable wall thus moves downwardly with respect to the spigot and the spigot thus slides within the discharge aperture. Once the moveable wall has moved a certain distance, the spigot will move out of engagement with the discharge aperture and the contents of the reservoir then discharge through the discharge aperture, under both gravity and the action of the pressure created in the reservoir, into the main volume of the container. The component within the reservoir is thus added to and mixed with the component in the body of the container. The cap may then be moved upwardly, that is to say removed from the container, whose contents may then be dispensed in mixed form. Alternatively, the cap may be left in position and the contents of the container dispensed through an opening in the cap.

The moveable wall of the insert may take various forms and in one simple embodiment it comprises a resilient, e.g. elastomeric, member, which is connected to the fixed cylindrical wall and in which the discharge aperture is formed. When the pressure is created in the reservoir, this will result in distension of the moveable wall and thus in movement of it away from the closure plate. In an alternative embodiment, the fixed wall includes a depending cylindrical portion which co-operates with and is in sliding sealed engagement with a cylindrical wall forming part of the moveable wall. The cylindrical wall connected to the moveable wall will thus co-operate with the further cylindrical wall connected to the fixed cylindrical wall in the manner of a piston and cylinder which are moveable relative to one another under the action of a pressure within the reservoir. However, both of the above embodiments necessitate the insert being constituted by two separate components which are connected together and this will necessarily result in additional manufacturing costs. In the preferred embodiment, however, the insert constitutes a one piece moulding of plastics material, e.g. polypropylene, and the moveable wall is connected to the fixed wall by at least two annular fold lines of opposite sense. The discharge aperture will be formed within the annular fold lines. When a pressure should act within the reservoir, this will result in relative rotation of the portions of the insert about the fold lines in opposite senses and thus in movement of the moveable wall away from the closure plate.

In one embodiment of the invention, the closure plate includes a cylindrical portion which constitutes the piston. The cap and the piston are thus constituted by one and the same component. In this event, it is preferred that the insert is captive on the cylindrical portion of the cap and this will mean that the cap and the insert may be removed from the container as a single unit.

However, in an alternative embodiment, there is a separate piston, a portion of which is engaged by a portion of the closure plate. In use, the piston will be below the closure plate and this means that if the cap and thus the closure plate are moved downwardly, the closure plate will act on the piston and press it downwardly also, that is to say towards the insert. It may be convenient in this alternative embodiment for the cap and thus also the piston not normally to be removed from the container at all and in this event a flow opening will be formed in the piston to permit the flow of the two-component liquid in the container, once mixed, to be discharged from the container.

It is preferred that the engaging portions of the piston and the closure plate are annular and form a substantial seal, whereby a discharge chamber is defined between the closure plate and piston with which the flow opening communicates, a discharge passage being formed in the closure plate and communicating with the discharge chamber.

It is preferred that the closure includes a first non-return valve cooperating with the flow opening and arranged to prevent the flow of liquid through the flow opening from the discharge chamber. As liquid is discharged from the container through the discharge passage, it is desirable for its volume to be replaced by a corresponding volume of air and it is therefore preferred that an air opening is formed in the piston which communicates with the atmosphere via an air passage formed in the closure plate. It is preferred that the closure also includes a second non-return valve cooperating with the air opening and arranged to prevent the flow of air and liquid through the air opening to atmosphere.

In order to be able to position and locate the insert within the container in a simple manner, it is preferred that the end of the fixed cylindrical wall, opposite to that to which the moveable wall is connected, carries an outwardly extending peripheral flange for engagement with the rim of a container, e.g. a bottle. This will mean that the insert can simply be placed within a container by locating the flange on the rim extending around the dispensing opening of the container.

The closure may be secured to the container by any of the well known means for doing so but it is preferred that the internal surface of the depending skirt carries a screw thread for co-operation with a complementary screw thread on the exterior of the container. If, as is preferred, the closure is retained on a container by means of a screw thread, the necessary downward movement of the cap is of course achieved by screwing the cap further onto the container before unscrewing it and removing it from the container. In order to ensure that this downward movement of the cap is not effected inadvertently, that is to say at a time when mixing of the two components is not in fact required, it is preferred that the closure includes an integral tear-off band connected to the free end of the depending skirt. In use, the tear-off band will engage a peripheral ledge or projection on the outer surface of the container and thus prevent downward movement of the closure. Such tear-off bands are conventional in the field of container closures and consist of an annular band connected to the remainder of the closure by one or more readily rupturable integral webs or bridges. Such a tear-off band conventionally includes a projecting tab or lug which may be grasped by the user who simply pulls on the tab, thereby progressively removing the band and rupturing the webs or bridges. Once the tear-off band has been removed, the cap may be screwed downwardly to expel the contents of the reservoir into the container before moving it upwardly, that is to say unscrewing it from the container.

As mentioned above, it may be convenient for the insert to be automatically removed from the container at the same time as the cap is removed since otherwise opening the container would necessitate two separate steps, that is to say removal of the cap followed by removal of the insert. In order to achieve this, it is preferred that the insert is captive on the cylindrical portion of the cap. This may be readily achieved by providing the internal surface of the fixed cylindrical wall with an inwardly projecting bead or shallow peripheral flange at its upper end and by providing a similar bead or peripheral flange extending outwardly from the lower end of the cylindrical portion of the cap. Thus, when the cap is moved upwardly during opening of the container, the cylindrical portion of the cap will slide within the fixed cylindrical wall until the two beads or cylindrical flanges come into contact, whereafter continued upward movement of the cap will result in upward movement of the insert also, whereby the two components will be removed simultaneously.

The invention also embraces a multiple component container closed by a closure of the type referred to above. The container is in practice likely to be a bottle and this bottle may be of the type with a neck at its upper end, whereby the upper end of the bottle is of smaller diameter than its lower end, or it may be of wide-mouthed type, whereby the bottle is of substantially continuous diameter over its entire length.

In the preferred embodiment, in which the closure includes a tear-off band, it is preferred that the outer surface of the container carries one or more external projections, e.g. a peripheral flange, which is engaged by the tear-off band, whereby downward movement of the cap with respect to the container is prevented until the tear-off band has been removed.

Further features and details of the invention will be apparent from the following description of two specific embodiments, which is given by way of example with reference to the accompanying drawings, in which.

Figure 1:
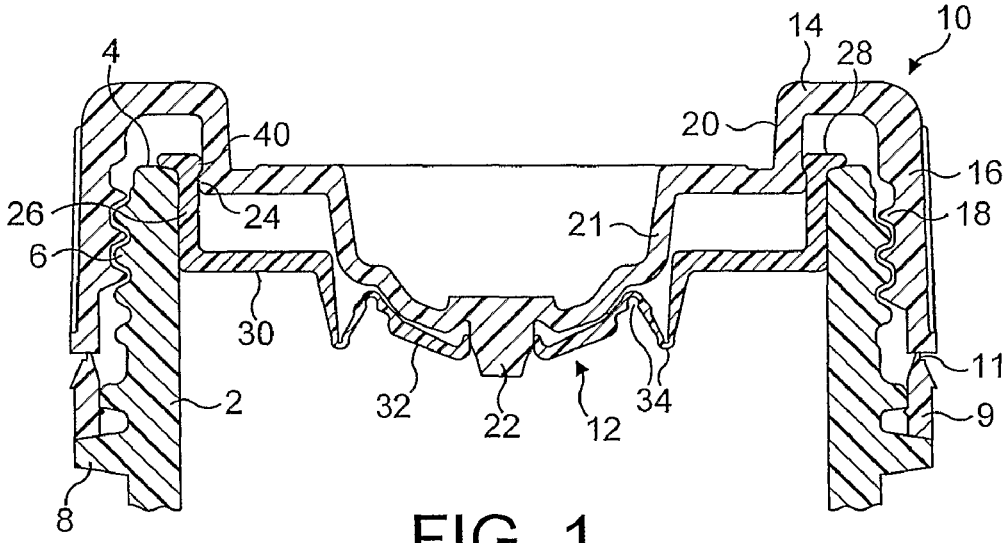
FIG. 1 is an axial sectional view of the upper portion of a container closed by a closure in accordance with the invention before expulsion of the component contained within the reservoir.

Referring firstly to FIG. 1, a container, typically a bottle, includes a neck 2, which terminates in the upward direction at a rim 4, which extends around the dispensing opening of the bottle. Provided on the external surface of the neck 2 is a screw thread 6 and situated immediately below the screw thread is an annular ledge or flange 8, the purpose of which will be discussed below. The bottle is closed by a closure comprising two separate components, namely a cap 10 and an insert 12. The cap 10 constitutes a generally circular cover plate 14, integral with whose outer edge is a depending skirt 16, formed on the inner surface of which is a screw thread 18, which is complementary to and, when in position, in mesh with the screw thread 6 on the neck of the bottle. Integral with the free end of the skirt 16 is a tear-off band or tamper-evident band 9 comprising an annular strip of plastic material connected to the depending skirt by a number of flimsy, circumferentially spaced bridges or, as in this case, by a thin and readily tearable web 11. The tear-off band 9 is discontinuous in the circumferential direction and includes a projecting tab at one of its ends or some other means by which the tear-off band may readily be gripped by the user. The cover plate 14 includes a central depressed portion 20 of cylindrical shape, which may be considered to constitute a piston. Integral with the underside of the base of the cylindrical portion 20 is a cup-shaped portion 21, integral with whose underside is a depending circular section valve member or spigot 22. Integral with the lower end of the outer surface of the cylindrical portion 20 is an annular bead 24, the purpose of which will be discussed below.

The insert 12 also constitutes a one piece plastic moulding of e.g. polypropylene. It includes a stationary cylindrical wall 26, the external diameter of which is substantially equal to the internal diameter of the neck 2 of the bottle. Integral with the upper end of the cylindrical wall 26 is an outwardly projecting radial flange 28. As may be seen, the insert may be readily positioned and retained in the bottle by resting the flange 28 on the rim 4. Integral with the lower end of the cylindrical wall 26 is an annular connecting portion 30, which is of generally L-shape in axial cross section. Integrally connected to the inner edge of the connecting portion 30 is a moveable wall 32. The connection is by way of two annular, concentric integral hinges or folds 34 of opposite sense. Formed in the centre of the moveable wall 32 is a discharge aperture 36, which is defined by an integral, annular lip 38, which extends upwardly and inwardly. Formed at the upper end of the internal surface of the cylindrical wall 26 is an inwardly extending annular bead 40, which is complementary to and co-operates with the upwardly extending annular bead 24 on the cylindrical portion 20.

After manufacture and filling of the bottle and application of the closure to it, the closure will be in the configuration shown in FIG. 1. Thus the two screw threads 6 and 18 are in meshing engagement, thereby firmly retaining the cap on the bottle. The tear-off band 9 is in engagement with the upper surface of the circumferential flange 8, whereby the cap 10 may not be screwed any further onto the neck of the bottle. The bottle contains one component of a liquid binary system, the other component of which is contained in the reservoir defined by the insert 12 and a cylindrical portion 20 of the cap. The reservoir is sealed by the sealed engagement of the outer surface of the cylindrical portion 20 with the internal surface of the cylindrical wall 26 and by the sealed engagement of the outer surface of the spigot 22 with the internal surface of the lip 38 defining the discharge aperture 36. If it is desired to dispense the contents of the container in mixed form, the tear-off band 9 is firstly removed. In order to achieve this, the free end of the tear-off band 9 is gripped and pulled and this results in progressive tearing of the web 11 until the band 9 is no longer connected to the depending skirt 16. The band 9 is now removed from the bottle and discarded. The cap may now be screwed further onto the neck of the bottle and as this occurs the piston constituted by the cylindrical portion 20 of the cap moves downwardly into the cylinder constituted by the fixed cylindrical wall 26, thereby creating an increased pressure within the reservoir. This pressure acts on the moveable wall 32 and the force thus produced results in rotation of the pair of annular webs or plates on each side of each fold 34 in opposite directions. This rotational movement or unfolding of the folds 34 results in downward movement of the moveable wall 32 and thus sliding movement of the lip 38 downward along the surface of the spigot. After a certain amount of movement has occurred, the spigot 22 comes free of the hole 36 and the moveable wall adopts the position shown in FIG. 2. The interior of the reservoir now communicates with the interior of the container and the contents of the reservoir are therefore discharged through the aperture 36 into the body of the container, both under the action of the excess pressure created in the reservoir and under the action of gravity. The two components are therefore now mixed together within the container. The cap is now removed from the bottle by unscrewing it and as it moves upwardly the cylindrical portion 20 will slide relative to the cylindrical wall 26. However, when the cylindrical portion 20 again reaches the position shown in FIG. 1, the two annular beads 24 and 40, come into engagement with one another. They are so dimensioned that the bead 40 cannot slide over the bead 24 and continued upward movement of the cap 10 thus results also in upward movement of the insert 12. The cap and insert are thus connected together and are removed from the container as a single unit. The mixed contents of the container may now be dispensed.

In a modified embodiment, a shallow annular recess (not shown in the drawings) is provided at the lower end of the internal surface of the cylindrical wall 26. As the piston 20 moves downwardly, the annular projection 24 will engage into this recess and this will mean that when the cap is subsequently removed from the bottle in the upward direction, the insert 30 will immediately begin to move with it and no relative movement of the cap and insert will occur.

The above description relates to a closure for a container for a two-component system. It will, however, be appreciated that a very similar closure could be used for a system comprising three or even more components. Thus in the case of a three-component system, the insert could be modified by providing it with an integral upstanding web which will divide the reservoir into two isolated compartments. The base of each compartment may be constituted by a respective moveable wall connected to the remainder of the insert by two or more respective fold lines of opposite sense. Formed within each moveable wall is a respective discharge aperture and integrally depending from the cylindrical portion 20 is a respective spigot 22, which is slideably accommodated within the associated discharge aperture. In use, the two compartments are filled with respective liquid components and when the three components are to be mixed together, the cap is again screwed downwardly and the increased pressure results in both of the moveable walls moving downwardly and thus in both the components contained within the closure being injected into the further component within the body of the container.

Figure 2:
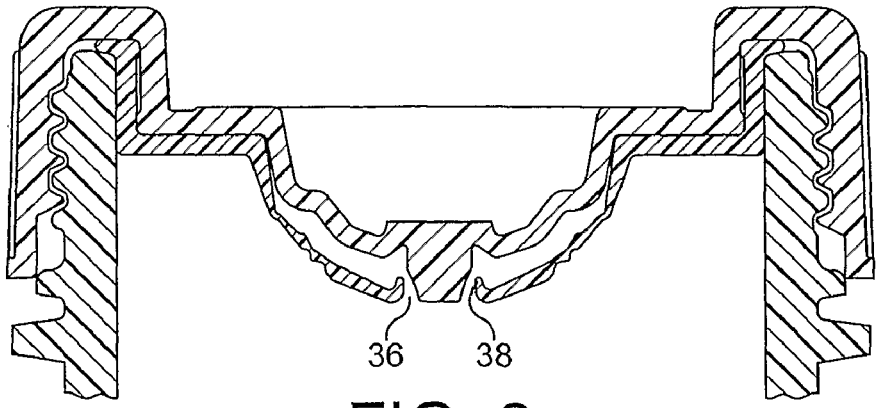
FIG. 2 is a similar view showing the position of the moveable wall after expulsion of the contents of the reservoir.
Figure 3:
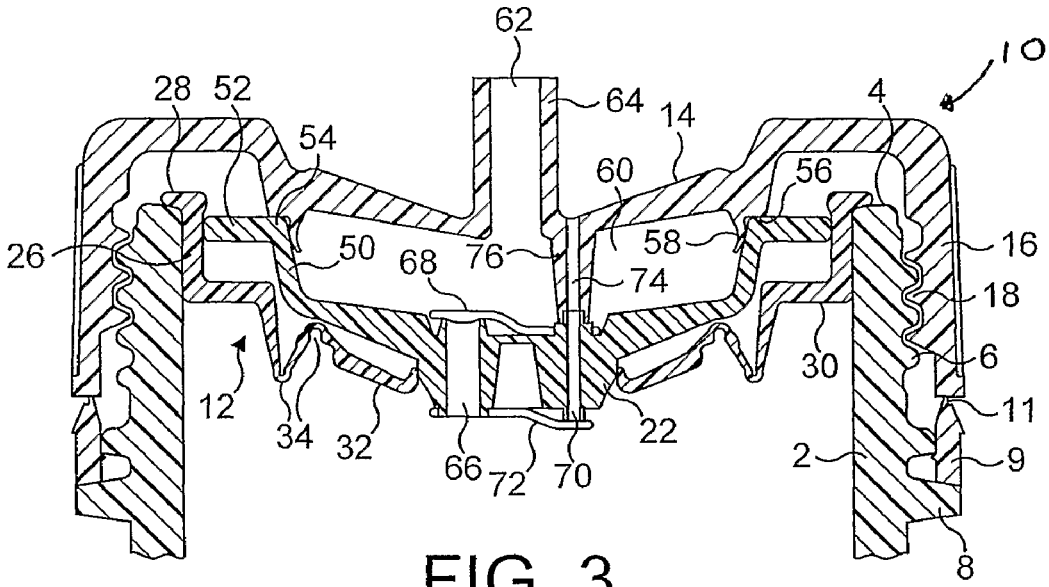
FIG. 3 is a view similar to FIG. 1 of a hair colorant dispenser with a modified closure.
Figure 4:
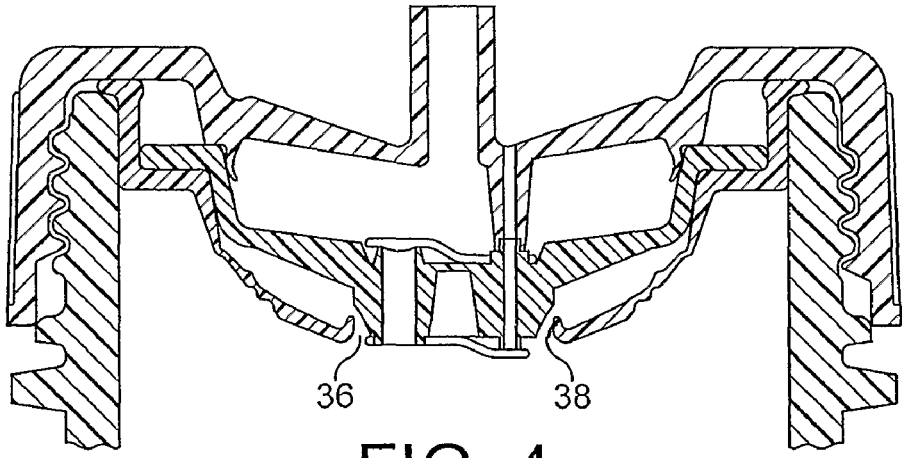
FIG. 4 is a view similar to FIG. 2 showing the container of FIG. 3 after expulsion of the contents of the reservoir.

Whilst the first embodiment described with reference to FIGS. 1 and 2 is intended for use with e.g. a beverage container, the second embodiment illustrated in FIGS. 3 and 4 is intended for use with a hair colorant. The second embodiment is similar to the first embodiment and the same reference numerals are used for similar components but differs from it in a number of important respects. Thus, firstly, the piston in the second embodiment is not constituted by a portion of the cap but is constituted by a separate piston member 50. The piston 50 includes an annular flange 52, the outer edge of which is in sliding contact with the internal surface of the cylindrical wall 26. The inner edge of the flange 52 is integral with a cup-shaped depending portion, depending from the centre of the lower surface of which is the valve member or spigot 22. The junction of the flange 52 with the cup-shaped member constitutes an annular ledge or shoulder 54, which is engaged from above by a downwardly facing annular surface 56 afforded by the closure plate 14 of the cap. Situated inwardly of the surface 56 is a depending, annular resilient flange 58, the outer surface of which is in sealed engagement with the upper portion of the internal surface of the cup-shaped portion of the piston 50. The closure plate 14 and piston 50 thus define a substantially sealed discharge chamber 60. The chamber 60 communicates with the atmosphere through a discharge passage 62 defined by an upstanding tube 64, to which an applicator may be connected. The chamber 60 also communicates with the interior of the container via a flow passage 66, which is selectively closed by a non-return valve 68 of any desired type which permits the flow of liquid from the interior of the container into the discharge chamber 60 but not in the opposite direction. Also formed in the piston 50, specifically in the valve member or spigot 22, is an air flow passage 70, which cooperates with a non-return valve 72, arranged to permit the flow of air into the interior of the container but not in the opposite direction. The air flow passage 70 communicates with one end of an air flow passage 74 defined by a tube 76 depending from the closure plate 14, the other end of the air flow passage 74 communicating with atmosphere.

In use, the body of the container will contain one component of a binary component hair colorant, that is to say the solvent or carrier liquid. The colouring material itself is contained in liquid form in the reservoir defined by the piston 50 and insert 12. If it is desired to use the hair colorant, the tear-off band 9 is removed and the cap 10 is screwed downwardly. This downward movement of the cap and thus of the closure plate is transmitted to the piston 50 via the surface 56 and shoulder 54 and the piston 50 thus also moves downwardly towards the insert 12. The resultant increase in pressure in the reservoir results in downward movement of the moveable wall 32 until the lip 38 around the aperture 36 comes out of engagement with the surface of the valve member 22, as shown in FIG. 4. The colorant material now flows and/or is expelled from the reservoir and becomes mixed with the solvent in the container. If, as preferred, the container is of flexible type, the container is now inverted and a pressure applied to its side wall. This results in the mixed hair colorant preparation flowing through the flow passage 66, thereby opening the non-return valve 68, into the discharge chamber 60. It then flows out through the discharge passage 62 and into an applicator which may be attached to the discharge tube 64. The colorant is then applied to the hair of the user. When the pressure on the wall of the container is relaxed, the wall will return to its original position and air will be sucked into the interior of the container through the air passages 74 and 70 through the non-return valve 72. The renewed application of pressure will result in further hair colorant being expelled through the flow passage 66 and discharge passage 62 and the non-return valve 72 prevents any colorant material being expelled through the air passage 70. The closure is thus left in situ on the mouth of the container and not normally removed.

It will be appreciated that numerous modifications may be effected to the two embodiments described above. In one modification, which is not illustrated, the tear-off band 9, which also serves as tamper evidence, is replaced by a band which is not intended to be torn off but is still connected to the remainder of the cap by one or more readily rupturable flimsy bridges. The lower surface of this tamper-evident band is inclined upwardly and inwardly, when seen in axial section, and the upper surface of the peripheral flange 8 on the container is similarly inclined. When it is desirable to open the container and mix its contents, the tamper-evident band is not torn away and instead the cap is simply screwed downwardly. The opposing inclined surfaces of the tamper-evident band and the flange on the container results in the downward movement of the cap producing outward or bulging movement of the tamper-evident band, which then slides downwardly over the flange on the container. When the rupturable bridge or bridges have passed over the lower corner of the peripheral flange, by which time the contents of the reservoir will have been discharged into the body of the container, the upper surface of the tamper-evident band will engage beneath the lower surface of the peripheral flange. When the cap is then unscrewed and thus moves upwardly, the rupturable bridge or bridges will rupture and the tamper-evident band will then remain in position around the neck of the container beneath the peripheral flange, thus providing evidence of tampering or evidence that the components of the container have already been mixed.

The invention claimed is:

1. A closure for a multiple component container including an insert, a piston and a cap, the insert and the piston defining a reservoir and the insert comprising a fixed cylindrical wall and a moveable wall connected thereto and moveable with respect thereto by the action of gas pressure within the reservoir, the moveable wall having a discharge aperture formed therein, the cap comprising a closure plate, integral with whose outer edge is a depending skirt by means of which the cap may be secured to a container, the closure plate cooperating with the piston such that movement of the closure plate towards the insert results in movement of the piston also in the same direction, the piston forming a sliding seal with the internal surface of the fixed cylindrical wall, and a valve member which is integral with the piston and is slideably received in and seals the discharge aperture.

2. A closure as claimed in claim 1 in which the moveable wall is connected to the fixed wall by at least two annular fold lines of opposite sense.

3. A closure as claimed in claim 1 in which the closure plate includes a cylindrical portion which constitutes the piston.

4. A closure as claimed in claim 3 in which the insert is captive on the cylindrical portion of the cap.

5. A closure as claimed in claim 1 including a separate piston, a portion of which is engaged by a portion of the closure plate.

6. A closure as claimed in claim 5 in which a flow opening is formed in the piston.

7. A closure as claimed in claim 6 in which the engaging portions of the piston and the closure plate are annular and form a substantial seal, whereby a discharge chamber is defined between the closure plate and piston with which the flow opening communicates, a discharge passage being formed in the closure plate and communicating with the discharge chamber.

8. A closure as claimed in claim 7 including a first non-return valve cooperating with the flow opening and arranged to prevent the flow of liquid through the flow opening from the discharge chamber.

9. A closure as claimed in claim 1 in which an air opening is formed in the piston, which communicates with the atmosphere via an air passage formed in the closure plate.

10. A closure as claimed in claim 9 including a second non-return valve cooperating with the air opening and arranged to prevent the flow of air through the air opening to atmosphere.

11. A closure as claimed in claim 1 in which the moveable wall is connected to one end of the fixed cylindrical wall, the other end of which carries an outwardly extending peripheral flange for engagement with the rim of a container.

12. A closure as claimed in claim 1 in which the internal surface of the depending skirt carries a screw thread for cooperation with a complementary screw thread on the exterior of a container.

13. A closure as claimed in claim 1 including an integral tear-off band connected to the free end of the depending skirt.

14. A multiple component container closed by a closure as claimed in claim 1.

15. A multiple component container closed by a closure as claimed in claim 13, the outer surface of the container carrying one or more external projections, which is engaged by the tear-off band.

16. A multiple component container as claimed in claim 15, wherein the one or more external projections includes a peripheral flange.

* * * * *